United States Patent [19]

Eccleston et al.

[11] Patent Number: 4,668,942

[45] Date of Patent: May 26, 1987

[54] SIGNAL ANALYSIS APPARATUS INCLUDING RECURSIVE FILTER FOR ELECTROMAGNETIC SURVEILLANCE SYSTEM

[75] Inventors: Larry Eccleston, Marshall; Earl R. Goodrich, II, East Lansing; Manot Swasdee, Battle Creek, all of Mich.

[73] Assignee: Progressive Dynamics, Inc., Marshall, Mich.

[21] Appl. No.: 673,015

[22] Filed: Nov. 19, 1984

[51] Int. Cl.[4] ..... G08B 13/24

[52] U.S. Cl. ..... 340/551; 340/572

[58] Field of Search ..... 340/572, 551; 364/550, 364/572724; 342/89, 101; 328/167

[56] References Cited

U.S. PATENT DOCUMENTS

| | | | |
|---|---|---|---|
| 3,908,116 | 9/1975 | Bjornsen | 364/572 X |
| 4,038,536 | 7/1977 | Feintuch | 364/572 X |
| 4,168,496 | 9/1979 | Lichtblau . | |
| 4,171,913 | 10/1979 | Wildy et al. | 364/498 X |
| 4,321,586 | 3/1982 | Cooper . | |
| 4,527,152 | 7/1985 | Scarr et al. | 340/572 |
| 4,539,558 | 9/1985 | Fearon | 340/551 X |

FOREIGN PATENT DOCUMENTS

| | | | |
|---|---|---|---|
| 8303203 | 9/1983 | PCT Int'l Appl. . | |
| 8302027 | 9/1983 | PCT Int'l Appl. . | |
| 2110439 | 6/1983 | United Kingdom | 340/572 |

*Primary Examiner*—James L. Rowland
*Assistant Examiner*—Brian R. Tumm
*Attorney, Agent, or Firm*—Price, Heneveld, Cooper, DeWitt & Litton

[57] ABSTRACT

The specification discloses a digital/analog signal analyzer for an electromagnetic surveillance system. Included is a notch filter having a switched capacitor filter controlled by a phase lock loop for nulling a time-varying driving frequency from the received signal. The analyzer further includes structure for digitizing the received signal and for implementing a recursive filter to enhance digital feature extraction. The recursive filter in turn includes structure for delaying a read address for subsequent use as a write address to facilitate the rapid updating of data in memory. Also included is a digital-to-analog converter assembly having a pair of piggy-backed digital-to-analog converters to produce an analog signal dependent upon both a mantissa and an exponent of a digital number in scientific notation.

9 Claims, 6 Drawing Figures

SIGNAL ANALYSIS APPARATUS INCLUDING RECURSIVE FILTER FOR ELECTROMAGNETIC SURVEILLANCE SYSTEM

BACKGROUND OF THE INVENTION

The present invention relates to electromagnetic surveillance systems, and more particularly to an apparatus for analyzing the signals received thereby emitted from articles within the system in response to the driving field.

A wide variety of electromagnetic surveillance systems has been developed in an attempt to deter pilferage from retail stores. Typically, these systems are positioned at the entrances and/or exits to retail stores so that individuals entering or leaving the store must pass through the system. The most common type of system includes a device for generating an electromagnetic field and an antenna for receiving signals emitted by articles within the system in response to the electromagnetic field. By analyzing the signals so received, it is possible to determine what types of articles are present within the system. Unauthorized articles include markers or tags, preferably in the nature of Permalloy or other material of high permeability, hidden or affixed to merchandise. If an article within the system is determined to be a Permalloy strip, the surveillance system sounds an alarm or otherwise alerts store personnel to the fact that pilferage is occurring. Examples of such surveillance systems are provided in U.S. Pat. No. 4,535,323, issued Aug. 13, 1985, entitled PREAMPLIFYING AND SIGNAL PROCESSING METHOD AND APPARATUS FOR THEFT DETECTION SYSTEMS; U.S. Pat. No. 4,524,350, issued June 18, 1985, entitled DETECTION LOGIC AND SIGNAL PROCESSING METHOD AND APPARATUS FOR THEFT DETECTION SYSTEMS; and U.S. patent application Ser. No. 364,264, filed Mar. 14, 1983, entitled INHIBIT AMPLIFIER AND PROCESSOR METHOD AND APPARATUS FOR THEFT DETECTION SYSTEMS, by the present inventors and/or co-workers, and owned by the assignee of the present application.

One problem occuring with prior systems is the less than 100 percent certainty in determining the types of articles moving through the surveillance system. Although the Permalloy strips have a rather distinctive response to the electromagnetic field generated by the system, their response is not unlike certain other permeable materials such as keys, pocket knives, pens, and other articles routinely carried by individuals. The uncertainty in identifying the Permalloy tags dictates one of two choices. First, the system can be "oversensitive" meaning that an alarm is sounded any time that an article which might conceivably be a Permalloy strip is moving through the system. The drawback of this approach is that the alarm will sound occasionally when an object other than a Permalloy strip is moving through the system, embarrassing the customer then moving through the surveillance system. This is extremely undesirable among store owners. Second, the system can be "undersensitive" meaning that the alarm is sounded only when the system is absolutely sure that a Permalloy tag is moving therethrough. The system can however miss tags which pass through certain areas of the opening. Pilferage will therefore continue even though the surveillance system is in place.

Accordingly, a significant drawback in prior art systems is the lack of sensitivity and/or selectivity of the signal analysis circuitry causing the system to sound erroneous alarm signals and miss Permalloy tags.

SUMMARY OF THE INVENTION

The aforementioned problems are solved in significant part by the present invention. Essentially, a signal analyzer for an electromagnetic surveillance system is provided including circuitry for digitizing the received signal and implementing a digital recursive filter to clarify and analyze the signal, permitting relatively easy and accurate feature extraction.

More particularly, the analyzer in a first aspect includes circuitry for periodically sampling the received signal, a "baseline" storage device for storing a plurality of values each corresponding to one of the sampling periods, a baseline function unit for periodically comparing the sample values and the stored values and modifying the stored values in response to the comparison, a "data" storage device for storing a plurality of second values each corresponding to one of the sampling periods, and a data function unit for periodically comparing the sample values and the first and second stored values and modifying the second values in response to the data comparison. The baseline stored values are updated less frequently than the data stored values, such that the baseline provides a relatively long-term filter for removing the relatively steady-state signal from the received signal. The data values, on the other hand, are updated relatively frequently to more closely track changes in the received signal created by the presence of objects within the surveillance field. The types of objects within the system can be relatively accurately determined by analyzing the baseline values and/or the data values (i.e., "feature extraction").

In a second aspect of the invention, a unique notch filter is provided for tracking and removing the relatively dominant, variable driving frequency from the received signal. More specifically, the notch filter includes a switched capacitor filter including an input port, an output port, and a control port, wherein the filter removes a frequency determined by a control frequency applied to the control port. Also provided is a phase-locked oscillator having an input coupled to the received frequency and producing an output which is a multiple of the driving frequency. The output of the phase-locked oscillator is coupled to the control terminal of the switched capacitor filter so that the variable drive frequency is filtered by the filter system.

In a third aspect of the invention, the digital recursive filter includes a memory addressing circuit which permits data to be rapidly retrieved from, updated, and restored to its memory location, for example using relatively inexpensive random access memory (RAM) components. This circuit includes a device for time delaying the read address for a subsequent write operation. Consequently, the addressing circuitry need not generate a write address, but can simply use the read address from a previous retrieval.

In a fourth aspect of the invention, the invention comprises a digital-to-analog (D/A) converter assembly permitting a digital value in scientific notation including an exponent portion and a mantissa portion, to be converted to analog form. More particularly, the assembly includes a pair of digital-to-analog converters, one of which receives the mantissa portion of the digital signal and the other of which receives the exponent portion of the digital signal. The output analog signal of one of the D/A converters is applied as the reference analog signal to the second D/A converter. Therefore, the output of the other D/A converter is dependent upon both the mantissa and exponent portions of the digital value.

The signal analyzer of the present invention therefore modifies and digitizes the received signal in a manner permitting enhanced feature extraction enabling enhanced selectivity and sensitivity. First, the unique notch filter follows or tracks a varying drive frequency to null the drive frequency from the received signal. Second, the digitally implemented recursive filter provides an accurate representation or picture of the long-term or steady-state portion of the received signal and of the short-term or transient portion of the received signal. The recursive filter averages multiple signal samples to provide a clearer signal representation. The digitized values can be more accurately analyzed than can their analog counterparts. Third, the addressing circuitry wherein the read address is delayed for a subsequent write operation greatly improves the speed and accuracy with which the digital values can be retrieved, updated, and stored. This enhances the rapid operation of the recursive filter. Fourth, the D/A converter assembly enables a digital number stored in scientific form to be rapidly yet simply converted to a corresponding analog signal dependent both upon the mantissa and exponent.

An electromagnetic surveillance system incorporating the present signal analyzer is therefore both more sensitive and more selective than previous systems. The present system issues fewer erroneous signals and misses fewer Permalloy tags than has previously been possible. The various aspects of the present invention, both singly, and in combination, provide a significant contribution to this rapidly developing field.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
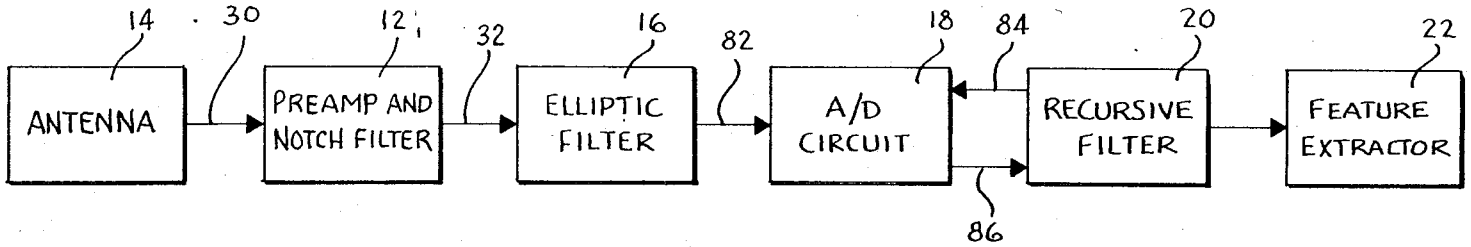
FIG. 1 is a schematic diagram of the electromagnetic surveillance system signal analyzer of the present invention.

A signal analyzer for an electromagnetic surveillance system constructed in accordance with a preferred embodiment of the invention is illustrated in FIG. 1 and generally designated 10. Basically, the signal analyzer includes preamp and notch filter 12, elliptic filter 16, analog/digital circuit 18, and digital recursive filter 20. Circuit 12 is coupled to antenna 14, while filter 20 is coupled to feature extractor 22. The function of preamp and notch filter 12 is to amplify the signal received from antenna 14, strip the drive frequency from the received signal, and scale the remaining signal to a proper range. Elliptic filter 16 is an antialiasing filter. Analog/digital (A/D) circuit 18 digitizes the processed waveform and compares the digitized signal with a previously stored digital value. Recursive filter 20 manipulates the digitized waveforms to update a "data" digitized waveform and to less frequently update a "baseline" digitized waveform. The long-term or steady-state portion of the received signal is retained in the "baseline" data, while the transient signals, for example due to articles moving through the surveillance system, are retained in the "data" information. Feature extractor 22 is interactive with recursive filter 20 to analyze the stored information and determine whether the perturbations reflected in this information are indicative of a Permalloy strip. When a strip is detected, an alarm is sounded. The digitization and processing of the received waveform are more accurate than in prior inventions; and therefore, signal analyzer 10 is more sensitive and selective than currently available surveillance systems.

The means for generating the electromagnetic field used in conjunction with the present signal analyzer 10 is disclosed in U.S. Pat. No. 4,634,975 filed Sept. 17, 1984, by Eccleston et al, entitled METHOD AND APPARATUS FOR PRODUCING ELECTROMAGNETIC SURVEILLANCE FIELDS, assigned to the assignee of the present application, the disclosure of which is hereby incorporated by reference. The drive frequency of this field generation means is nominally 9.80 kilohertz (KHz), and the period of the drive frequency is therefore 102 microseconds. The field generated by the field generation means changes three times with each 60 hertz (Hz) power cycle (i.e., every 5.55 milliseconds) such that 54 drive field cycles occur per each drive configuration period. The cycle of the 9.80 KHz drive frequency can be digitized into 128 sample periods (i.e., 1.25 megahertz (MHz)) as will be described, so that each sample cycle is approximately 797 nanoseconds. The actual drive field frequency in each drive configuration period varies somewhat from the actual drive frequencies in the adjacent drive configuration periods.

Antenna 14 (FIG. 1) is also described in referenced U.S. Pat. No. 4,634,975, filed Sept. 17, 1984, and is coupled to signal analyzer 10 by line 30 using conventional techniques.

Preamplifier and Notch Filter Circuit

Preamplifier and notch filter 12 (FIGS. 1 and 2) is a low-noise preamp which also strips the driving waveform from the received signal and scales the remaining signal to a proper range. Because the drive frequency varies with time, the notch filter tracks the drive frequency so that the drive frequency is nulled by the filter regardless of its frequency.

Figure 2:
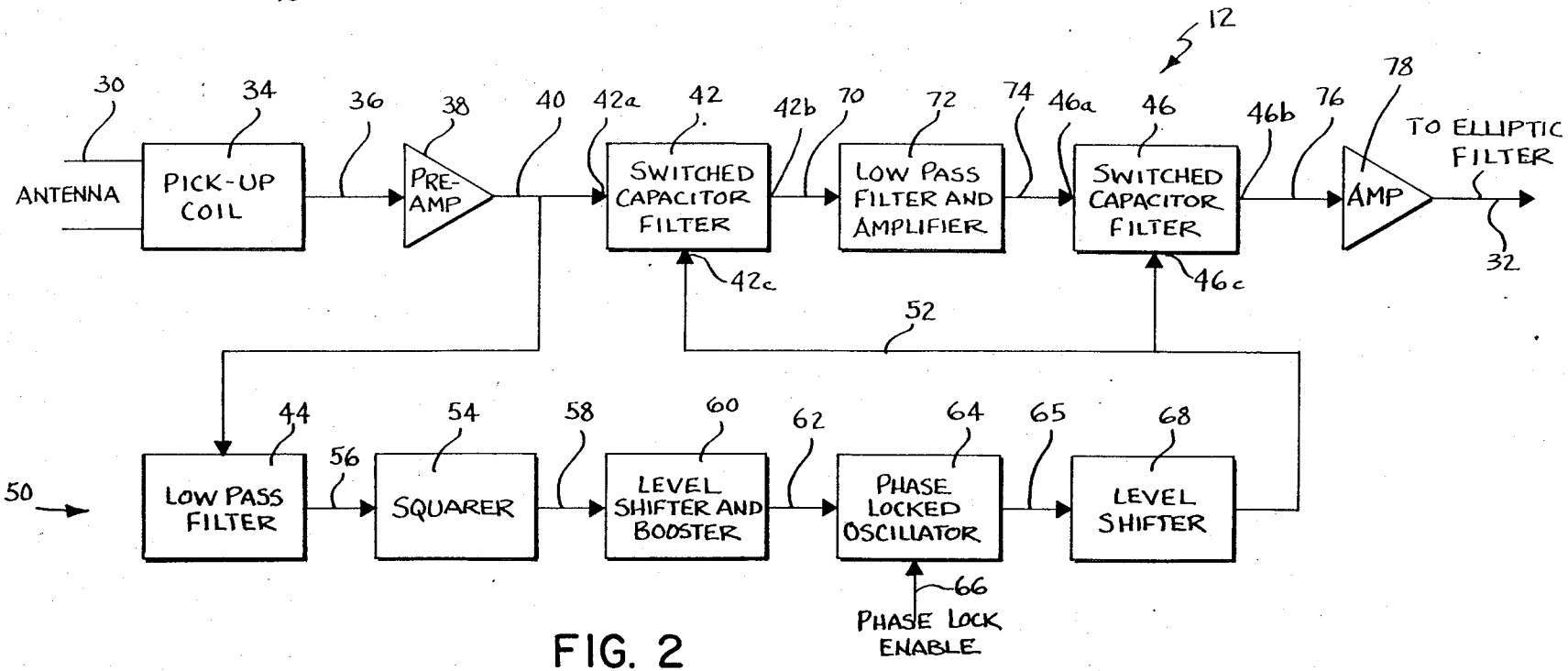
FIG. 2 is a schematic diagram of the preamplifier and notch filter circuit of the signal analyzer.

The details of preamplifier and notch filter 12 are illustrated in FIG. 2 wherein line 30 is the lead from antenna 14 (see also FIG. 1), and line 32 is the line leading to elliptic filter 16 (see also FIG. 1). Pickup coil and transformer 34 is coupled to line 30. The coil includes a transformer which amplifies the signal received ten times and outputs the amplified signal on line 36. Preamp 38 further amplifies the signal received on line 36 eleven times and outputs the further amplified signal on line 40, which leads both to switched capacitor filter 42 and low-pass filter 44.

The dominant frequency on line 40 is the drive frequency, which as indicated above is nominally 9.80 KHz, but in reality will probably be somewhat less and vary with time. Switched capacitor filters 42 and 46 are controllable filters each including an input port 42*a* and 46*a*, an output port 42*b* and 46*b*, and a control port 42*c* and 46*c*. Each of filters 42 nulls out a frequency as selected by a control signal applied to the control ports 42*c* and 46*c*. In the preferred embodiment, each of filters 42 is a switched capacitor, for example as sold by National Semiconductor, and nulls out a frequency which is 1/99.35 times the control frequency applied to the control port. For purposes of the present application, the appropriate control frequency is generated by phase-lock loop 50. In the preferred embodiment, the controlled frequency developed by phase-lock loop 50 is 99 times the drive frequency.

Phase-lock loop (PLL) 50 (FIG. 2) has an input line 40 connected to preamp 38 and an output line 52 coupled to the control terminals 42*c* and 46*c* of the switched capacitor filters 42 and 46. PLL 50 produces a control frequency on line 52 which is 99 times the dominant filtered frequency inputted to the PLL on line 40. Low-pass filter 44 permits only frequencies of 50 KHz or less to pass through to squarer 54 over line 56. Consequently, spurious noise is rejected by filter 44 so that the signal passing over line 56 is dominantly a sine wave corresponding to the drive frequency of the frequency generating means. Squarer 54 squares up the waveform received on line 56 to produce a square wave on line 58. In the preferred embodiment, squarer 54 comprises an op amp with an open loop and diode limiting, such that the square wave exiting squarer 54 on line 58 has a 0.6 volt amplitude. The zero cross-over points in the signal on line 58 are identical to the zero cross-over points in the signal on line 56.

Continuing with the description of PLL 50, level shifter and booster 60 (FIG. 2) receives a square wave on line 58 and outputs a square wave on line 62. The square wave on line 62 oscillates between 0 and 15 volts as compared to the square wave on line 58 which oscillates between 0.6 volts and −0.6 volts. Phase-locked oscillator 64 receives the square wave on line 62 and outputs a square wave on line 65 whose frequency is 99 times that of the signal on line 62. The construction of phase-locked oscillator 64 is generally well-known to those having ordinary skill in the art. A "phase lock enable" signal is applied to phase-locked oscillator 64 over control line 66 permitting the phase comparison to be turned on and off. The phase lock enable signal is used to bypass transients during the start and end of a driving frequency burst drive configuration period. Preferably, opto-isolators are used to implement this signal to eliminate noise. Level shifter 68 receives a square wave on line 65 oscillating between 0 and 15 volts and outputs a square wave on line 52 oscillating between 0 and 5 volts. The output square wave on line 52 is applied to control ports 42*c* and 46*c* of switched capacitor filters 42 and 46.

Filter 42 (FIG. 2) provides 23 decibel (dB) loss or filtering of the frequency component of the signal received on line 40 as controlled by the frequency applied to the control port 42*c*. In the preferred embodiment, the frequency removed is the control frequency on line 52 divided by 99.35. Consequently, the signal entering switched capacitor filter 42 on line 40 is filtered to provide 23 dB loss of the drive frequency to produce a filtered signal on line 70. The filtered signal then passes through low-pass filter (200 KHz) and amplifier 72 which removes the high-frequency clock signal and amplifies the filtered signal five times to produce an output signal on line 74. The signal on line 74 passes through switched capacitor filter 46 to produce an output signal on line 76 which has an additional 23 dB loss of the drive frequency in an analogous manner to that provided by filter 42. Consequently, the signal on line 76 has 46 dB loss of the drive frequency. Finally, the filtered signal on line 76 passes through amp 78 which provides a further ten times amplification to produce an output signal on line 32 to elliptic filter 16 (see also FIG. 1).

Summarizing, the operation of preamp and notch filter 12 is to receive an input signal on line 30, filter the drive frequency from the received signal, and amplify the signal 5500 times through pickup coil 34, preamp 38, amplifier 72, and amp 78. The processed signal is delivered to elliptic filter 16.

Elliptic Filter Circuit

Elliptic filter 16 (FIG. 1) is a conventional seven-pole antialiasing filter for A/D circuit 18. The elliptic filter functions as a low-pass filter and in the preferred embodiment has a corner frequency at 150 KHz and 130 dB per decade roll-off.

Analog/Digital Circuit

A/D circuit 18 (FIGS. 1 and 3) receives an analog signal on line 82 from elliptic filter 16 (see also FIG. 1) and a pair of digital numbers over lines 84 from recursive filter 20, and outputs a digital signal on line 86 back to the recursive filter. Line 82 includes resistor 88 having a nominal value of 5 KOhm to provide a signal current into summing junction 90.

As will be explained, two sets of digitized waveforms are stored in recursive filter 20. A brief understanding of these digitized waveforms is necessary at this point to describe the operation of A/D circuit 18. A first set of digitized waveforms denominated the "baseline" is a digitized version of the analog signal updated once per drive configuration period. One "baseline" waveform is maintained for each of the three drive configurations. Each individual baseline is therefore updated once every 1/60 of a second. The analog signal is digitized at a clocking rate of 1.25 MHz and the baseline of the recursive filter includes one memory location for each of the 128 separate time intervals or sample periods. The second digitized value is denominated the "data" and also includes one memory location for each of the 128 clock cycles in the drive frequency cycle. The value of the "data" tracks the difference between the digital "baseline" for the time slice and the instantaneous analog signal of the time slice. The "baseline" numbers are stored as integers in a sixteen-bit field with an offset of 32K. Only the twelve most significant bits (MSBs) of the "baseline" numbers are used by A/D circuit 18. The "data" numbers are stored in scientific form including an eight-bit mantissa with an offset of 128 and a three-bit exponent with no offset. Therefore, a mantissa of 128 corresponds to "zero", 127 to "minus one", 129 to "plus one", and so forth.

VRef is supplied to all of digital-to-analog converters (DACs) 92, 94, and 96 in circuit 18 (FIG. 3) on line 95 and in the preferred embodiment is 10 volts. A 2.5 KOhm resistor 96 interconnects line 95 and input port 98 of DAC 92. DAC 92 is a bipolar current output DAC having a twelve-bit digital input port 100 for receiving the twelve MSBs of "baseline" numbers on line 84*a*. The analog output of DAC 92 is outputted at port 102. More particularly, the current sinking into or emitted from DAC 92 at input port 102 is equal to the digital value of the twelve MSBs of "baseline" minus 2048, divided by 2048 times the current applied to the DAC at analog input port 98. Consequently, an analog signal is provided on line 104 which corresponds to or is proportional to the digital value "baseline".

Both DACs 94 and 96 are eight-bit current multiplier converters. That is to say that each DAC includes an analog input port, a digital input port, and two analog output ports. The analog signal or current at one analog output port is equal to the analog signal, or reference current, inputted to the input port times the digital input divided by 256. The analog signal at the other analog output port is equal to the difference between the reference current and the first output current.

DAC 96 receives as its digital input at digital input port 106 a value equal to "two" raised to the exponent of the "data" number. The three-bit data exponent is first applied to decoder 108 through three-bit line 84*b*. The output of decoder 108 is the complement of $2^{DATA\ EXP}$. Consequently, only one line of eight-bit bus 112 will be low at any one time. Resistor 114 having a nominal value of 2.5 KOhm interconnects reference line 95 and analog input port 116 of DAC 96. Output port 118 provides a current sink which is equal to the current applied to input port 116 times $$\frac{2^{\text{DATA EXP}}}{256}.$$

The current produced at complementary analog output port 120 is the complement of the current at port 118—namely, the current applied to input port 116

$$\left[1 - \frac{2^{DATA\ EXP} + 1}{256}\right].$$

Output port 120 is coupled to summing junction 90 by line 121. Both of the currents at output ports 118 and 120 sink into DAC 96.

Resistor 122 having a value of 5 KOhms interconnects reference line 95 and second DAC input port 124. Additionally, output port 118 of DAC 96 and input port 124 of DAC 94 are interconnected via line 126 to affect the reference voltage applied to DAC 94. The second input port 128 of DAC 94 is interconnected to reference line 95 through a 2 KOhm resistor 130 and a 1 KOhm potentiometer 132. The two input ports 124 and 128 are applied to an op amp internal to DAC 94 causing the reference current at port 128 to be dependent upon the voltage across resistor 122 which is dependent upon the output current of exponent DAC 96. The described resistor values cause the reference current to DAC 94 to be twice the output current on line 126. The eight-bit "data" mantissa is applied to digital input port 134 of DAC 92 on eight-bit line 84*c*. The analog signal at output port 138 is equal to the "data" mantissa minus 128, divided by 256 times the reference current applied to DAC 94. The analog output port 138 of DAC 94 is coupled to summing junction 90 by line 140.

Reference line 95 and summing junction 90 are interconnected by line 142 which includes resistor 144 having a resistance of 2 KOhm and a 1 KOhm potentiometer 146. Potentiometers 132 and 146 enable A/D circuit 18 to be balanced with resistor 114 having a nominal resistance of 2.5 KOhm. The current $IRef_1$ applied to input port 116 of DAC 96 is equal to:

$$IRef_1 = \frac{VRef}{2.5K\ Ohm}$$

The output current $IO_1$ sunk into DAC 96 at output port 118 is equal to:

$$IO_1 = -IRef_1 \frac{2^{EXP}}{256}$$

and accordingly, the complementary current $IO_1BAR$ sunk into DAC 96 at output port 120 is equal to:

$$\overline{IO_1} = -IRef_1\left(1 - \frac{2^{EXP} + 1}{256}\right)$$

The voltage $V_1$ at input port 124 of DAC 94 is equal to:

$$V_1 = VRef - 5\ KOhm IO_1$$

and therefore the current $IRef_2$ inputted to DAC 94 at input port 128 is equal to:

$$\begin{aligned} IRef_2 &= \frac{VRef - V_1}{2.5K\ Ohm} \\ &= \frac{VRef - (VRef - 5K\ Ohm\ IO_1)}{2.5K\ Ohm} \\ &= 2IO_1 \\ &= 2IRef_1 \frac{2^{EXP}}{256} \end{aligned}$$

The current sunk at output port 138 of DAC 94 is equal to:

$$\begin{aligned} IO_2 &= -IRef_2 \frac{MANT}{256} \\ &= -2IRef_1 \frac{MANT}{256} \cdot \frac{2^{EXP}}{256} \end{aligned}$$

Potentiometer 146 is set such that the current into summing node 90 on line 142 is $$\frac{255}{256} IRef_1$$

to provide an offset for the currents into summing node 90 from data DACs 94 and 96. For a "data" mantissa value of 128, the currents on lines 121, 140, and 142 sum to zero regardless of the exponent. More generally, the sum of the currents at summing junction 90 from lines 121, 140, and 142 is equal to:

$$I_{DATA} = -IRef_1\left[1 - \frac{2^{EXP} + 1}{256}\right] - 2IRef_1 \frac{MANT}{256} \cdot \frac{2^{EXP}}{256} + IRef_1 \frac{255}{256} =$$

-continued $$I_{Ref_1}\left[-1+\frac{2^{EXP}+1}{256}-\frac{MANT}{128}\cdot\frac{2^{EXP}}{256}+\frac{255}{256}\right]=$$

$$-I_{Ref_1}\left(\frac{MANT-128}{128}\right)\frac{2^{EXP}}{256}$$

Consequently, the current contribution from lines 121, 140, and 142 is equal or corresponds to the digital "data" value stored in the described offset scientific notation.

Line 148 is coupled between summing junction 90 and ground 150 through resistor 152 to define a low impedance at junction 90 for noise and spike immunity. Amp 154 converts the current sum at junction 90 into a relatively small voltage. The voltage is positive if the current or analog signal received on line 82 is greater than the sum of the "baseline" and "data" values; while the voltage is negative if the analog signal received on line 82 is less than the sum of the "baseline" and "data" digital values. The voltage outputted by amp 154 is applied to comparator 155, which outputs a binary 0 if the voltage is positive and a binary one if the voltage is negative. This binary signal is delivered on line 86 to the recursive filter 20.

Recursive Filter Circuit

Figures 3, 5:
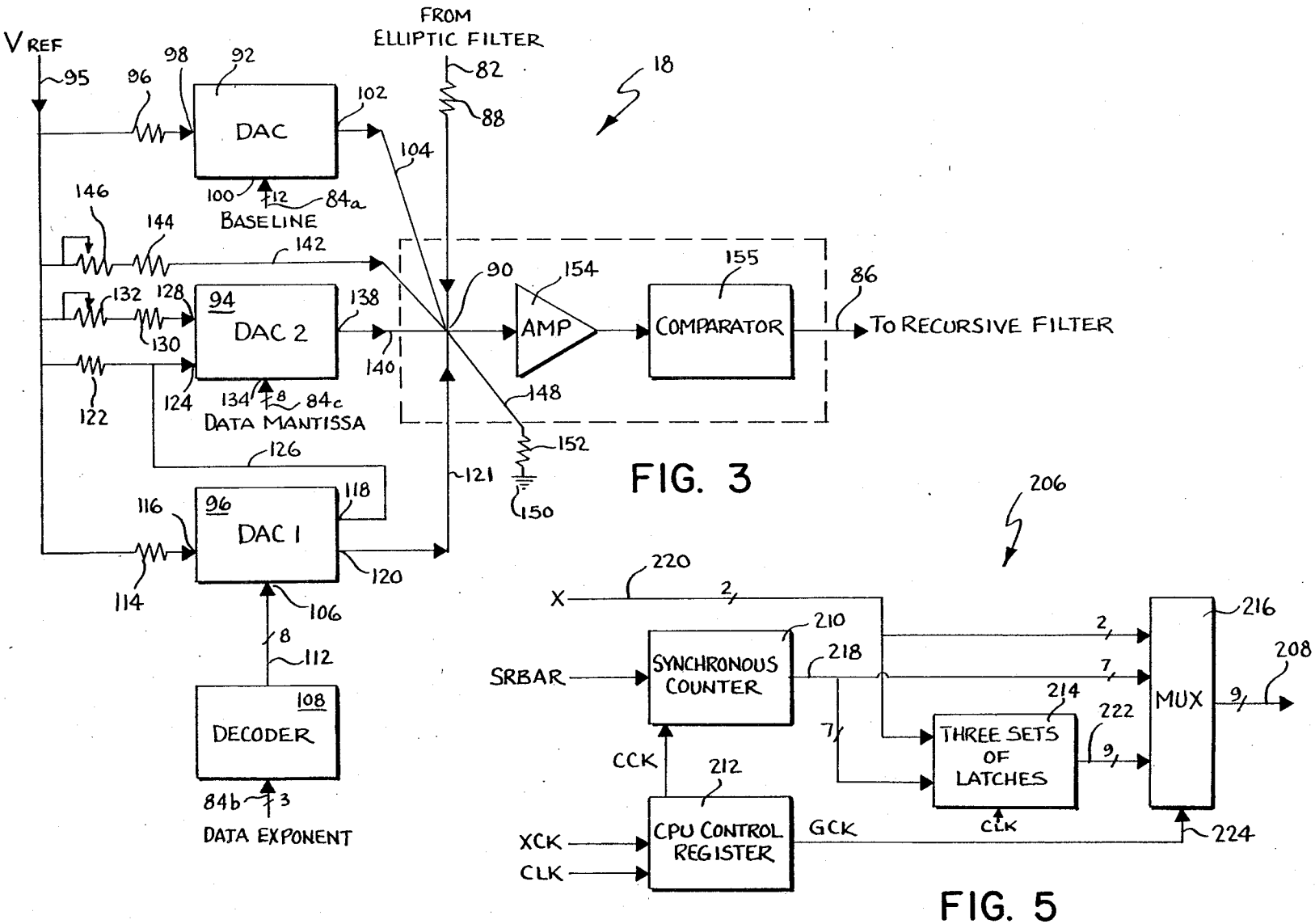
FIG. 3 is a schematic diagram of the digital/analog circuit of the signal analyzer.
FIG. 5 is a schematic diagram of the address generator for the recursive filter memory.
Figure 4:
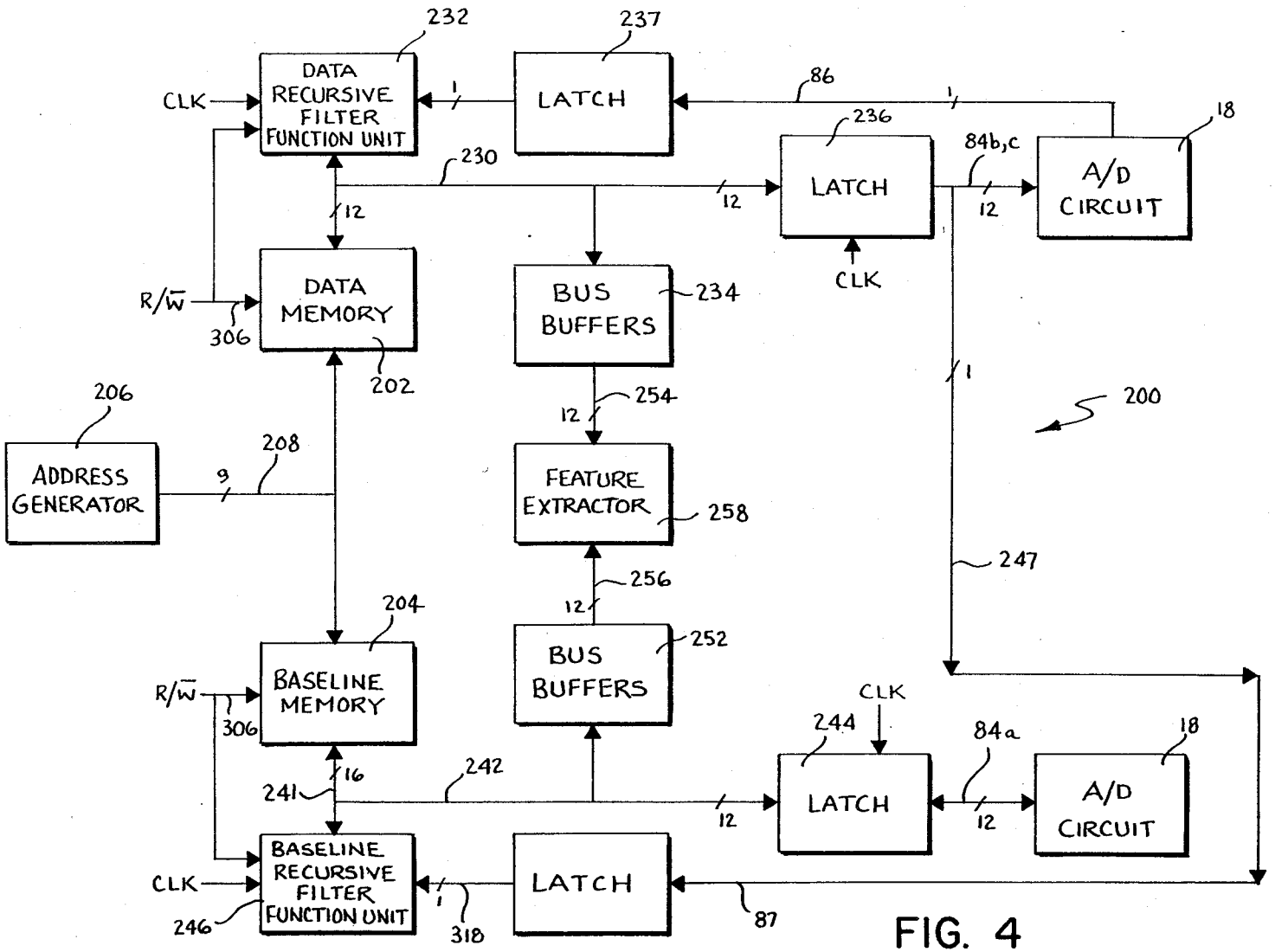
FIG. 4 is a schematic diagram of the recursive filter memory of the signal analyzer.
Figure 6:
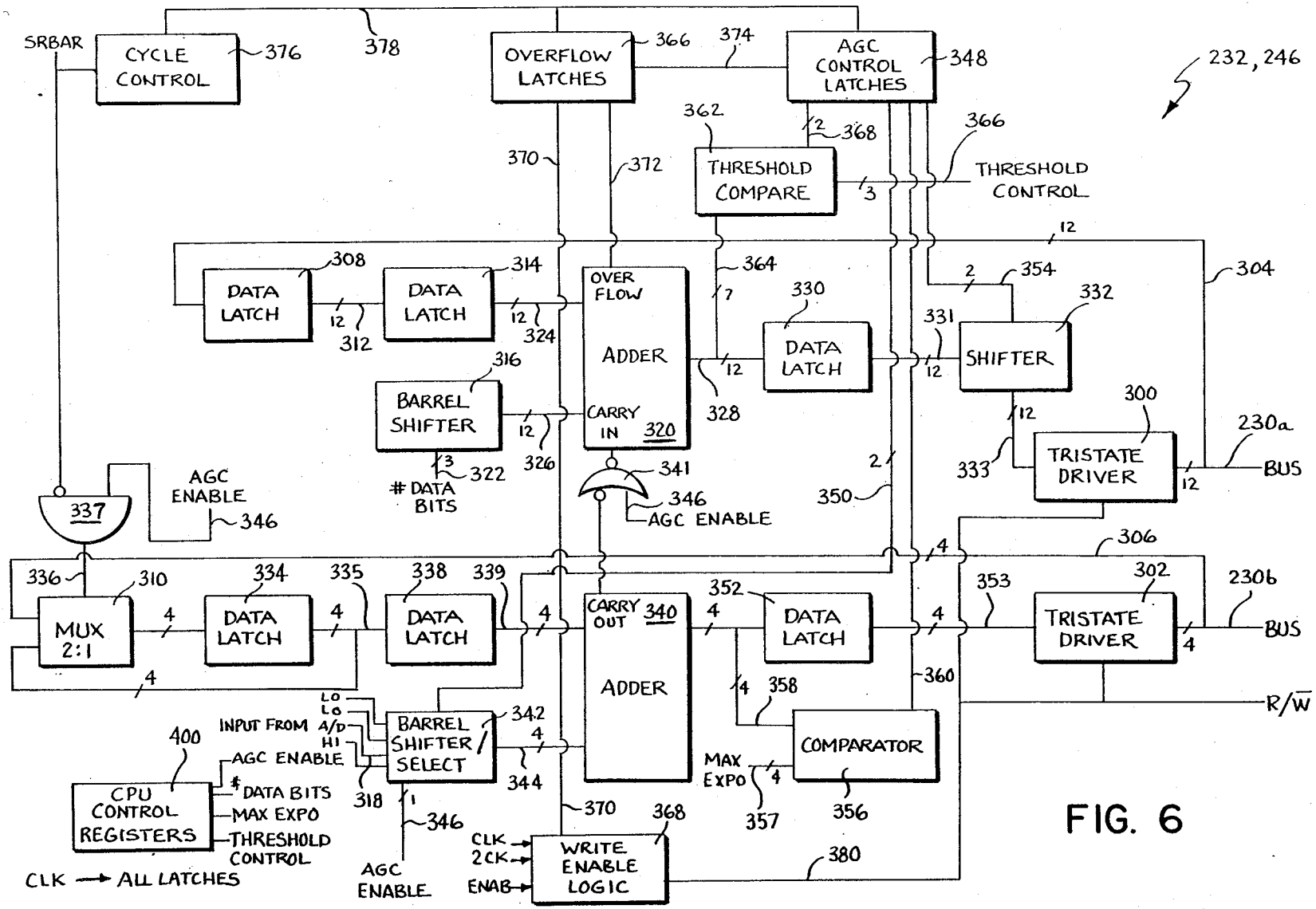
FIG. 6 is a schematic diagram of the recursive filter function unit of the signal analyzer.

Recursive filter 20 is detailed in FIGS. 4–6. Memory 200 (FIG. 4) of recursive filter 20 includes "data" memory 202 and "baseline" memory 204, each of which in the preferred embodiment is a static RAM providing 1K of sixteen-bit memory words. Only twelve bits of each word are used in data memory 204. Baseline memory 204 stores the long-term or "baseline" information, while data memory 202 stores the short-term or "data" information. Address generator 206 is provided to generate addresses for the accessing of memories 202 and 204. Address generator 206 generates a nine-bit address over line 208 which is applied to both of memories 202 and 204. The appropriate memory will be accessed depending upon the mode of operation as will be described.

Address generator 206 (FIG. 5) includes synchronous counter 210, CPU control register 212, three sets of sequential latches 214, and 2:1 multiplexer 216.

SRBAR is a synchronizing signal which goes low at sampling cycle "zero" of the clock CLK rate of 1.25 MHz. During each drive configuration period of 1/180 of a second, approximately 54 drive cycles from the field generator will be experienced. Appropriate control is provided so that approximately twenty of the drive cycles are ignored to provide transient settling. Then the succeeding 34 drive cycles are sampled. At the initiation of each drive cycle to be sampled, SRBAR goes low for one cycle of the 1.25 MHz cycling frequency to zero the synchronous counter 210. The signal CLK of 1.25 MHz is also applied to synchronous counter 210. When SRBAR goes low, synchronous counter 210 is reset to zero; and at each CLK pulse thereafter, synchronous counter 210 increments its output on line 218 by one.

The signal X is a two-bit signal applied to line 220 and corresponds to the phase definition of the field generator. In the preferred embodiment, the signal X continually cycles sequentially through the binary values 00, 01, and 10. The value X changes once every drive configuration period or as indicated above, once every 54 driving cycles.

The two-bit signal X and the seven-bit output of synchronous counter 210 are applied over lines 220 and 218, respectively, to multiplexer 216 and to latches 214. Latches 214 are clocked by CLK so that a signal applied to latches 214 is delayed three CLK pulses. Multiplexer 216 selects its input depending upon the signal on control line 224. When the GCK signal on line 224 is low, multiplexer 216 passes the signals on lines 220 and 218 to output line 208 as a read address. When the GCK signal on line 224 is high, multiplexer 216 passes the signal on line 222 from latches 214 to output line 208 as a write address. Address generator 206 therefore provides read/write addresses in opposite half cycles of GCK. The write address is always the read address of three GCK cycles in the past.

CPU control register 212 (FIG. 5) supplies the control signals GCK to MUX 216 and CCK to counter 210. The register includes two inputs—namely, XCK and CLK. As mentioned above, CLK is a clock of 1.25 MHz. XCK is a CPU generated signal used to unload or readout the memory for feature extraction as will subsequently be described. During normal operation, GCK is a gated version of CLK enabling both a write operation and a read operation to occur each CLK cycle; and CCK is CLK enabling counter 210 to count in harmony with the system. In the readout mode, CCK is XCK and GCK is set to force MUX 216 to select the undelayed counter output for a read address to rapidly unload the memory.

Address generator 206 (FIG. 5) therefore supplies read and write addresses on output line 208 to RAMs 202 and 204 (see also FIG. 4). The two high-order bits of the address determine which of the three memory sections (corresponding to each drive configuration) will be accessed. The seven low-order bits on output line 208 determine which of the 128 locations in the memory sections will be accessed. These locations are therefore accessed sequentially under the operation of synchronous counter 210 between 0 and 127. The read address applied to latches 214 over lines 220 and 218 exits latches 214 on line 222 exactly three clock cycles later as a write address. This greatly facilitates the speed at which the memory contents can be accessed, updated, and restored due to the fact that dual read/write addresses need not be generated by separate address generators. The read address is simply "memorized" in latch delay 214 for subsequent use as a write address.

Returning to FIG. 4, data memory 202 is also coupled through twelve-bit data bus 230 to data recursive filter function unit 232, bus buffers 234, and latch 236. During the first half of each clock cycle of the CLK signal, one memory location (corresponding to one time slice of the analog signal) is read from data memory 202 and latched in latch 236. This value then passes to A/D circuit 18 over bus **84*b* and 84*c* wherein the processing explained in conjunction with FIG. 3 is performed. The single digital output of A/D circuit 18 is returned on line 86 to "data" recursive filter function unit 232 through latch 237. This signal is used by function unit 232 as will be described to update the value stored in the memory location which is then written back into data memory 202 at the same address as specified by address generator 206. Because three CLK cycles elapse between the time that the data is read from the suitable memory location in 202 and the updated data is written at the address delayed by three clock cycles, the data returns to the identical memory location in memory 202**.

Baseline memory 204 (FIG. 4) is updated in an analogous manner. After the "data" memory locations have been updated through approximately 34 drive cycles of the signal, the "baseline" memory locations in 204 are updated once. Consequently, the "data" information is updated 128 times as often as the "baseline" information. Address generator 206 generates suitable addresses for baseline memory 204. All sixteen bits of each read memory location passes over sixteen-bit bus 241 to baseline recursive filter function unit 246. The twelve MSBs of each memory location pass over twelve-bit bus 242 to bus buffers 252 and to latch 244. The latched digital value passes over twelve-bit bus 84*a* to A/D circuit 18. The sign bit of the corresponding "data" word received over line 247 is used by function unit 246 to update the baseline memory word. Because A/D circuit and function unit 246 together require three cycles of the CLK signal, the addresses generated by generator 206 insure that the updated contents of each baseline memory location are returned to the proper location.

When the contents of data memory 202 or baseline memory 204 are to be unloaded for feature extraction, address generator 206 is driven in "readout" mode as described above and the contents of the memory locations are passed through buffers 252 and 234, respectively, to feature extractor 258.

Recursive filter 20 continually reads the contents of memory locations from data memory 202 and baseline memory 204, updates the information through A/D circuit 18 and function units 232 or 246, and restores the information at the proper memory location as controlled by the address generator 206. In the preferred embodiment, the value of each "data" memory location is increased by one if the analog signal is greater than the sum of the data and baseline signal; and the "data" memory location is decreased by one if the analog signal is less than the sum of the data and baseline words. Somewhat similarly, the "baseline" information, which is updated at the end of the "data" updates during each drive configuration period, is increased by one if the corresponding data word is positive and is decreased by one if the corresonding data word is negative.

"Data" and "baseline" function units 232 and 246 (FIG. 6) are identical to one another. Each function unit is a general sixteen-bit recursive filter processing element, which can be run in integer mode (sixteen-bit) or scientific notation mode (twelve-bit mantissa; four-bit exponent). Preferably, "baseline" unit 246 is run in integer mode, while "data" unit 232 is run in scientific notation mode with only eight bits of mantissa and three bits of exponent. Hereinafter, integer mode is referred to as baseline mode, and scientific notation mode is referred to as data mode. The mode selection is controlled by AGC ENABLE, which is high in data mode and low in baseline mode.

Generally, the twelve lines of tristate bus 230*a* follow a path through adder 320 to exit the function unit on the same lines. The four lines of tristate bus 230*b* follow a path through adder 340 to exit the function unit on these same lines. All latches are edge-triggered by the 1.25 MHz CLK. Drivers 300 and 302 drive incoming data to latch 308 and MUX 310, respectively.

When operated in baseline mode, twelve-bit adder 320 and four-bit adder 340 operate together to function as a sixteen-bit adder. The carry function between the adders occurs through NOR gate 341 which is enabled by the AGC ENABLE signal. Further, the low AGC ENABLE signal to AND gate 337 causes the input data from bus 306 to be selected and passed to latch 334.

Latches 308/334 (FIG. 6) provide a one CLK cycle delay allowing the data delivered to the A/D circuit and the response back (see also FIG. 4) to settle. The data within latch 308 then passes over bus 312/335 to data latches 314/338. The one CLK cycle delay provided by latches 314/338 enables the input from the A/D circuit to also be latched externally (see also FIG. 4) and shifted within barrel shifter 316/342. Barrel shifter 316/342 is a sixteen-bit shifter whose least significant bit (LSB) is tied high such that the LSB is always one. In baseline unit 246, the sign bit of the corresponding "data" word is tied through line 318 (see also FIG. 4) to the second LSB of the shifter. In data unit 232, the input from A/D circuit 18 is tied through line 318 to the second LSB of the shifter. The shifter propagates this input bit upwardly through the most significant bit (MSB). Consequently, (1) the sign of the corresponding "data" word in baseline unit 246 and (2) the input from the A/D circuit in data unit 232 determine the sign of the number to be applied to adder 320/340 from barrel shifter 316/342. Barrel shifter 316/342 is controlled by the value #DATA BITS over bus 322 such that the input bits are shifted an appropriate number of places to properly position the update information for addition in adder 320 depending upon (1) the rate of update, for example during start-up, and (2) the number of significant bits in the number to be updated. In the "data" function unit 232, eight bits of mantissa are included so that the least significant bit must be shifted eight positions in significance. In the "baseline" function unit, no shifting is required because the "baseline" digital values are sixteen-bit integers. The values within latches 314/338 and barrel shifter 316/342 are applied to adder 320/340 over lines 324/339 and 326/344, respectively, and the arithmetic sum of these numbers is outputted on bus 328/358 to data latches 330/352. The data latches 330/352 are included to provide one CLK cycle for adder 320/340 to settle and to hold the result for writing. The value within latches 330/352 are outputted over line 331 to shifter 332 and then over lines 333/353 to tristate drivers 300/302 so that the modified value can be returned to memory 202 or memory 204 (see also FIG. 4) over bus 230*a/b*. Shifter 332 is controlled as will be described to provide automatic gain control in the "data" function unit 232. In baseline unit 246, shifter 332 does nothing. Drivers 300/302 are enabled by R/WBAR, which also enables memory 202 or 204 to acquire the write.

If the result of an addition in adder 320/340 causes an arithmetic overflow or underflow, a signal on line 372 sets overflow latches 366 to inhibit a write for that sample cycle to prevent false data from being recorded. Once an overflow is detected, latches 366 inhibit writes in the following sample cycles until the overflow condition terminates.

When operated in the "data" or AGC mode, data function unit 232, AGC ENABLE is high and the data paths through adders 320 and 340 are markedly different. Adders 320 and 340 are therefore not interconnected, and MUX 310 selects a "data" exponent as will be described. The data path through adder 320 manipulates the "data" mantissa and operates as described in conjunction with baseline unit 246. The data path through adder 340 manipulates the "data" exponent.

In data mode, "data" values are restrained to a range of mantissas where possible, and an exponent specifies magnitude. When "data" mantissas approach the upper range limit, the entire set of mantissas is divided by two and the exponent incremented to reflect the change in magnitude. When all the "data" mantissas are below the lower range limit, the entire set of mantissas is multiplied by two and the exponent decremented.

Multiplexer 310 (FIG. 6) selects one of two four-bit inputs to be applied to data latch 334. The control for multiplexer 310 is applied over line 336 which is the output of AND gate 337. The inputs to AND gate 337 are inverted SRBAR and AGC ENABLE. As previously described, SRBAR goes low during a single clock cycle initiating the sampling sequence during each drive configuration period. AGC ENABLE is a signal which is always high in the "data" function unit 232 and always low in the "baseline" function unit 246. Consequently, MUX 310 in the "data" function unit selects the signal from tristate bus **230*b* during the first CLK cycle when SRBAR is low and selects the signal from data latch 334 in all other cases. Consequently, the first inputted exponent is continually circulated through data latch 334** in the "data" function unit so that the exponents of all "data" values will be identical to one another.

Data latches 334 and 338 (FIG. 6) provide two CLK cycles of delay to provide timing analogous to latches 308 and 314 discussed above enabling the exponent to be updated The "data" exponent of data latch 338 is then presented to adder 340 along with a value from shifter/selector 342. Shifter/selector 342 is part of barrel shifter 316 when AGC ENABLE applied to line 346 is zero. Otherwise, AGC modifier outputs a value on line 344 dependent upon a control signal generated by AGC control latches 348 and delivered over two-bit line 350. AGC control latches 348 generate a signal based upon the output of threshold compare 362. If no gain/shift is necessary, AGC control 348 outputs a value zero on line 350. If gain is required, AGC control 348 outputs a value 01 if the exponent is to be increased by one and outputs a value 10 if the exponent is to be decreased by one. Consequently, AGC modifier 342 under the control of the signal applied thereto over line 350 will generate a value 0, +1, or −1 depending upon whether the control signal on line 350 is 00, 01, 10, respectively. Adder 340 will therefore either pass, increment, or decrement, the exponent received from data latch 338 to output the modified exponent to data latch 352. As with data latch 330, latch 352 is provided to give adder 340 time to settle.

Shifter 332 is also controlled by AGC control 348 over line 354. The signal outputted on line 354 is identical to the signal outputted on line 350. The signals 00, 01, and 10 on line 354 will cause no shift, a shift corresponding to division by two, or a shift corresponding to multiplication by two, respectively. Consequently, shifter 332 will provide a mantissa shift corresponding to the exponent modification performed in adder 340.

Comparator 356 provides a control signal to AGC control 348 which either enables or disables the automatic gain control. Comparator 356 has a four-bit input MAX EXPO which specifies the maximum exponent permissible in the circuit, which in the preferred embodiment is seven Comparator 356 also has an input from line 358 and continually examines the exponent on line 358 to determine whether the new exponent would be greater than MAX EXPO or less than zero. A signal is issued over line 360 to AGC control 348, disabling automatic gain control, if the current exponent would fall out of the permissible range.

Threshold compare 362 (FIG. 6) monitors the need for automatic gain control (AGC). Threshold compare 362 receives a seven-bit input over line 364 which is the seven most significant bits of line 328. A three-bit control signal THRESHOLD CONTROL is also applied to threshold compare 362 over control line 366. THRESHOLD CONTROL specifies how many MSBs are to be examined to determine whether AGC is required. In the preferred embodiment, THRESHOLD CONTROL is a number between five and eight. So long as AGC is not required, THRESHOLD COMPARE outputs a signal of 00 over two-bit line 368 to AGC control 348. If AGC is required, THRESHOLD COMPARE outputs 01 if the exponent is to be increased by one with an appropriate shift in the mantissa and outputs 10 if the exponent is to be decreased by one with an appropriate shift in the mantissa. That is to say that if the mantissas are all too small, the mantissas should be multiplied by two on the next sampling sequence and the exponents decreased by one; and if any mantissa is too large, the mantissa should be divided by two and the exponent increased by one on the next sampling sequence. Latches 348 capture this information for an entire drive cycle. Because the exponents are required to remain uniform for a particular sampling sequence of 128 CLK cycles, latches 348 sample this information once per drive cycle for use in a subsequent cycle.

Overflow latches 366 issue a control signal to write enable logic 368 over line 370 when an overflow condition has occurred. Overflow latch 366 receives input control signals from adder 320 over line 372, from AGC control 348 over line 374, and from cycle control 376 over line 378. Cycle control 376 is responsive to the signal SRBAR to clear latch 366 at the beginning of a drive configuration period. Overflow latch 366 remains clear until it receives signals from lines 372 and 374 indicating that (1) adder 320 has overflowed and (2) division is not going to occur in the next corresponding drive configuration period.

Write enable logic 368 has four inputs—namely, CLK, 2CK, ENAB, and the control signal over line 370 from overflow latch 366. The signal 2CK has a frequency of 2.56 MHz or exactly twice that of CLK. The signal ENAB is high during sample cycles when the received signal is valid and low at all other times. The output signal of write enable logic 368 on line 380 is low during the second half of the write cycle when both ENAB is high and the signal on line 370 is low indicating that no overflow has occurred. Logic 368 also delays the write enable for three CLK cycles.

CPU control register 400 (FIG. 6) generates four signals—namely, #DATA BITS, MAX EXPO, AGC ENABLE, and THRESHOLD CONTROL. These inputs are applied to line 322 to barrel shifter 316, line 357 to comparator 356, line 346 to gates 337 and 341, and line 366 to threshold compare 362, respectively.

Recursive filter 200 stores two digital representations corresponding to the received analog signals. First, the "baseline" values, each of which is updated once during each power cycle (i.e., 1/60 of a second) provides information corresponding to the long-term or steady-state signal response. Second, the "data" values, each of which is updated 34 times per power cycle, provide information corresponding to the short-term or transient signal response. The "data" information attempts to track the difference between the "baseline" information and the instantaneous analog signal.

Feature extractor 258 is a digital device capable of processing and/or analyzing the "data" information and/or the "baseline" information to determine whether the values stored therein are indicative of a Permalloy strip. If a Permalloy strip is indicated, an alarm (not shown) perhaps located near the store entrance is sounded. So long as a Permalloy strip is not indicated, the alarm, of course, remains silent.

Conclusion

The signal analyzer of the present application is more selective and sensitive than the signal analyzers of known surveillance systems. This enables the more accurate detection of Permalloy strips which in turn results in fewer missed strips and fewer false alarms, both of which are of tremendous benefit to the store owner. The digital recursive filtering of the received signal provides an accurate and precise set of information regarding transient signals received from the system corresponding to transient articles such as Permalloy strips moving through the system. The relatively precise digitization of this signal enables the more accurate feature extraction for detection of Permalloy strips and the more accurate distinguishing of such signals from those indicative of other permeable articles, such as keys, pocket knives, or pens. The signal-averaging characteristic of the filter enables the rejection of asynchronous signals, such as generated by CRTs.

It should be understood that the above description is that of a preferred embodiment of the invention. Various alterations and changes can be made without departing from the spirit and broader aspects of the invention as set forth in the appended claims which are to be interpreted in accordance with the principles of patent law, including the doctrine of equivalents.

The embodiments of the invention in which an exclusive property or privilege is claimed are defined as follows:

1. A signal analyzer for an electromagnetic surveillance system, said analyzer being connectable to the antenna of the system to receive a signal therefrom, said analyzer compriding:

sample means for periodically sampling said signal to produce a plurality of sample values;

baseline storage means for storing a plurality of baseline values each corresponding to one of the sampling periods;

data storage means for storing a plurality of data values each corresponding to one of the sampling periods;

baseline function means for periodically camparing each baseline value and at least one of the associated sample and data values and modifying the baseline value as necessary in response thereto; and data function means for periodically comparing each sample value and the associated baseline and data values and modifying the data values as necessary in response thereto, the data values being modified more often than the baseline values whereby the data values are more responsive to transients in the signal.

2. A signal analyzer as defined in claim 1 wherein said baseline storage means and said data storage means both comprise digital storage devices.

3. A signal analyzer as defined in claim 2 wherein each of said baseline and data function means comprises:

converter means for converting the digital values to analog values;

comparison means for comparing the converted analog values and the sample values; and adder means for modifying the digital values in response to said comparison means.

4. A signal analyzer as defined in claim 2 wherein each of said baseline and data function units comprise:

address generator means for generating addresses of memory locations to be modified;

delay means for time delaying the addresses generated by the address generator means;

reading means for reading the data stored at the undelayed addresses and modifying the data during the time delay of the generated addresses; and writing means for writing the modified data at the delayed address exiting said delay means.

5. A signal analyzer as defined in claim 1 further comprising feature extraction means for examining at least one of the baseline values and the data values.

6. A signal analyzer to be coupled to the antenna of an electromagnetic surveillance system for analyzing signals received therefrom, said analyzer comprising:

sample means for repetitively sampling said signal at a plurality of discrete times;

baseline storage means including means for recording a baseline value for each discrete time;

data storage means including means for recording a data value for each discrete time;

baseline function means for periodically comparing each baseline value with at least one of the corresponding data value and the corresponding sampled signal and altering the baseline value as necessary in response to such comparison; and data function means for periodically comparing the difference between each sampled signal and the corresponding baseline value with the corresponding data value and altering the data value as necessary to be closer in value to the difference, the data values being updated more frequently than the baseline values.

7. A signal analyzer as defined in claim 6 wherein said baseline storage means and said data storage means both comprise digital storage devices.

8. A signal analyzer as defined in claim 7 wherein each of said baseline and data function units comprise:

address generator means for generating addresses of memory location to be modified;

delay means for time delaying the addresses generated by the address generator means;

reading means for reading the data stored at the undelayed addresses and modifying the data during the time delay of the generated addresses; and writing means for writing the modified data at the delayed address exiting said delay means.

9. A signal analyzer as defined in claim 7 wherein each of said baseline and data function means comprises:

converter means for converting the stored digital values to analog values;

comparison means for comparing the converted analog values and the sample values; and adder means for modifying the digital values in response to said comparison means.

* * * * *